United States Patent [19]

Miller et al.

[11] Patent Number: 4,752,013

[45] Date of Patent: Jun. 21, 1988

[54] TAMPER-EVIDENT CHILD-RESISTANT CAP AND BOTTLE WITH AXIAL LOCKING MEANS

[76] Inventors: Jack V. Miller; Ruth E. Miller, both of 700 N. Auburn Ave., Sierra Madre, Calif. 91024

[21] Appl. No.: 125,869

[22] Filed: Nov. 27, 1987

[51] Int. Cl.[4] ..... B65D 55/02

[52] U.S. Cl. ..... 215/216; 215/253

[58] Field of Search ..... 215/31, 216, 253, 251, 215/252, 258

[56] References Cited

U.S. PATENT DOCUMENTS

| | | | |
|---|---|---|---|
| 3,954,200 | 5/1976 | Willis | 215/216 |
| 4,540,098 | 9/1985 | Luker | 215/216 |
| 4,630,743 | 12/1986 | Wright | 215/216 |

*Primary Examiner*—George T. Hall

[57] ABSTRACT

A tamper-evident child-resistant screw cap for a bottle has an internally threaded closure portion and a depending cylindrical skirt portion having a pair of diametrically spaced arc segments, frangibly attached to the skirt and flexurally attached to the open end of the closure portion. The arc segments have downward-facing ratchet dogs engaged with upward-facing ratchet teeth on the bottle neck. Each arc segment has an upstanding rigid lever which may be inwardly depressed to disengage the ratchet dogs from the ratchet teeth of the bottle neck, permitting first removal of the cap only after breaking the frangible attachments and depressing the levers while unscrewing the cap; thereafter permitting removal only by depressing the levers while unscrewing the cap, or by breaking off the levers and arc segments at their flexural attachments, thereby converting the cap to a non child-resistant configuration.

8 Claims, 1 Drawing Sheet

TAMPER-EVIDENT CHILD-RESISTANT CAP AND BOTTLE WITH AXIAL LOCKING MEANS

BACKGROUND OF THE INVENTION

This invention relates to tamper-evident and child-resistant bottles and caps of the frangible skirt type wherein a broken skirt on the cap provides visual evidence of tampering or removal from an externally threaded bottle, without having to resort to an auxiliary seal over the cap and bottle neck as with prior art devices. The tamper resistant function of prior art devices is separate from the child-resistant function, and therefore are usually accomplished with separate parts which increase the cost of the cap. Also the children tend to learn how to open many child-resistant caps after a period of time. If the caps are made difficult enough to keep small children out, those elderly or ill adults that often have poor vision and limited manual dexterity and strength are unable to open them.

One purpose of this invention is to provide a bottle and a one piece cap of high reliability and security, with reasonable manufacturing tolerances, having more obvious tamper indication than presently known frangible separation skirt caps; maintaining a high degree of child-resistance, permitting operation by adults with limited vision and dexterity, and having adult removeable, child-resistance features.

Another purpose of this invention is to provide a tamper-eviden and child-resistant cap that will accommodate the manufacturing tolerances of glass bottles.

Reference is made to our co-pending application entitled: Tamper-Evident Child-Resistant Cap and Bottle with Radial Locking Means.

SUMMARY OF THE INVENTION

The present invention provides a tamper-evident child-resistant cap and a bottle having an externally threaded neck. The cap has unique properties including one-piece conventionally molded construction with a high degree of tamper-resistant security without resorting to additional sealing parts, combined with easily recognized evidence of removal or tampering. The cap includes child-resistant features operable or optionally removable by adults.

The invention includes an internally threaded closure portion and a depending skirt having a pair of diametrically opposed arc segments which are frangibly attached to the remainder of the skirt and attached to the closure portion with flexural supports. Each arc segment is provided with a plurality of downward-facing ratchet dogs in the form of elongated cantilevered beams; each dog having a proximal end attached to the arc segment of the skirt, and also having a distal end engagable with a plurality of upward-facing ratchet teeth radially disposed about and integrally molded with the bottle neck. The ratchet dogs are radially canted with their proximal ends ahead of the distal ends during rotational installation of the cap onto the bottle threads. The distal ends of the dogs are in canted engagement with the ratchet teeth on the bottle neck whereby the ratchet dogs ride over the ratchet teeth with negligible torque during installation, and compressively engage the ratchet teeth during attempted rotation in the removal direction, preventing removal.

Each arc segment is provided with a rigid upstanding lever extending to the plane of the closure end of the cap, whereby pressing the lever in an inward radial movement will rotate the arc segment outward on its flexure and disengage the ratchet dogs from the ratchet teeth of the bottle neck, permitting rotation of the cap in the removal direction. The frangible attachment of the arc segments to the remainder of the cap skirt makes tampering of the first opening of the cap dramatically obvious, as the torn interfaces are easily visible.

One preferred embodiment of the invention provides both the frangible attachments and flexural attachment of the lever and arc segment of sufficiently low strength that they may be torn loose from the cap by an adult to form a non child-resistant cap.

DETAILED DESCRIPTION OF THE DRAWINGS

Figure 1:
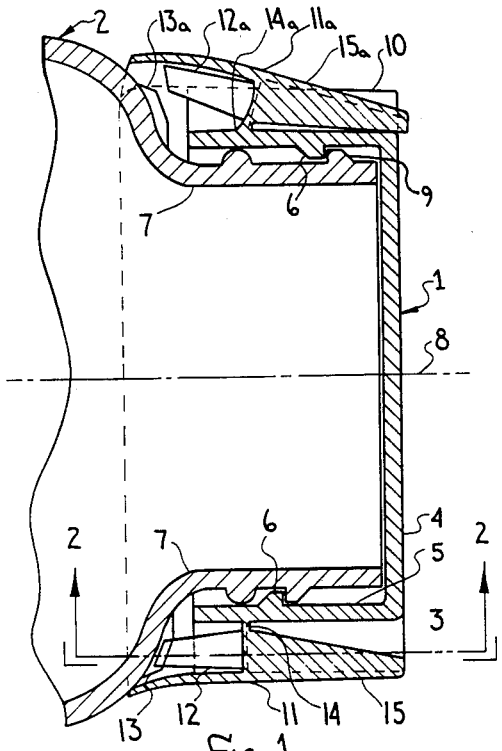
FIG. 1 is a cross-sectional view of the cap installed on the bottle according to the invention, taken along the axial centerline of the bottle.

In FIG. 1 the tamper evident cap 1 is shown with cap 1 fully seated on a closed-bottom bottle 2, and having a closure portion 3 including an end 4 terminating a cylindrical wall 5, which is provided with an internal thread 6. Bottle 2 is provided with a cylindrical neck 7 coaxial with cylindrical wall 5 about axial centerline 8, and having an external thread 9 engageable with internal thread 6 of closure portion 3 of cap 1. A depending skirt 10 is attached to closure portion 3 and is provided with one or more arc segments 11 and 11*a*. A plurality of axially oriented ratchet dogs 12 are radially disposed in a plane normal to axis 8 and extend downward to engage a plurality of upstanding and radially disposed ratchet teeth 13 and 13*a*, respectively. Arc segments 11 and 11*a* are attached to closure portion 3 by flexures 14 and 14*a*, respectively, and are provided with rigid levers 15 and 15*a*, respectively, extending axially to the closed end of closure portion 3. Lever 15 is shown in a locked condition, wherein ratchet dogs 12 are engaged with ratchet teeth 13; and lever 15*a* is shown in an unlocked condition, wherein ratchet dogs 12*a* are not engaged with ratchet teeth 13*a*.

Figure 2:
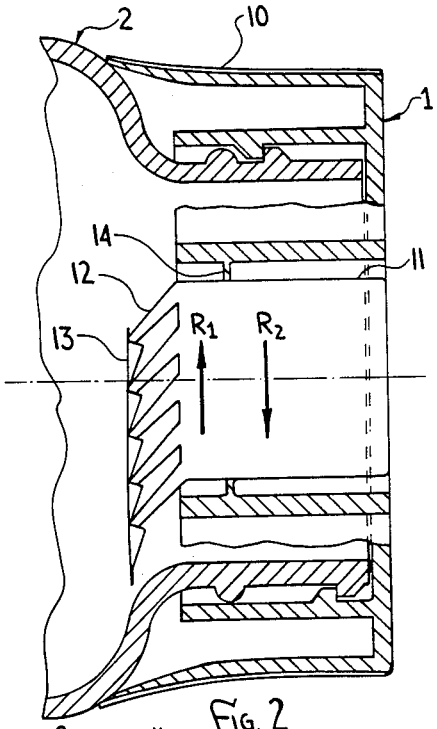
FIG. 2 is a cross-section along line 2—2 of FIG. 1 with edge sections along the axial centerline normal to FIG. 1.

In FIG. 2 cap 1 is shown seated on bottle 2 with ratchet dogs 12 engaged in removal-resisting angular contact with ratchet teeth 13. During rotation in direction R1 of the cap 1 on bottle 2, the ratchet dogs 12 flex to ride over teeth 13 with negligible torsional resistance until the cap is seated. Rotation in direction R2 of cap 1 is not possible as long as ratchet dogs 12 are in engagement with teeth 13. Rotation in direction R2 is possible only when all ratchet dogs are moved out of engagement with all ratchet teeth as shown with ratchet dogs 12*a* and ratchet teeth 13*a* in FIG. 1.

Figure 3:
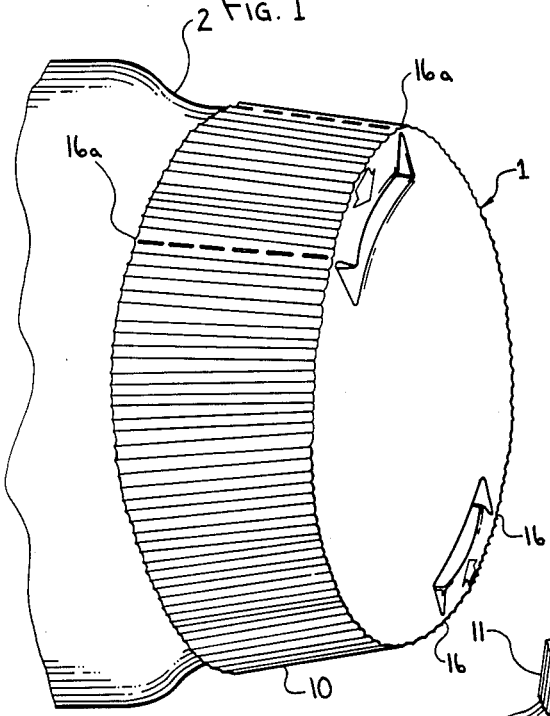
FIG. 3 is a perspective view of the cap and bottle of FIG. 1, shown in a locked condition.

In FIG. 3 cap 1 is shown installed on bottle 2, with frangible lines 16 and 16*a* attaching arc segments 11 and 11*a*, respectively to skirt 10, whereby cap 1 is not removable from bottle 2.

Figure 4:
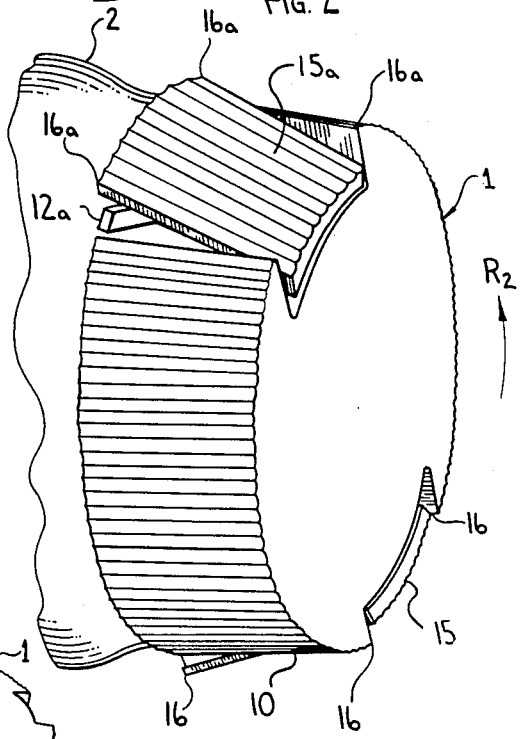
FIG. 4 is a perspective view of the cap and bottle of FIG. 1, shown in an unlocked condition.

In FIG. 4 levers 15 and 15*a* are shown having been depressed sufficiently to break frangible lines 16 and 16*a* away from skirt 10, permitting removal rotation in direction R2, but showing an obvious indication of entry.

Figure 5:
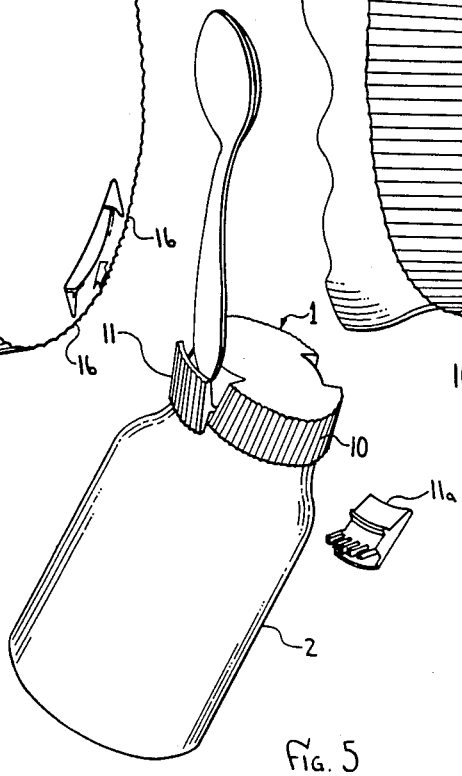
FIG. 5 is a perspective view of the cap and bottle of FIG. 3 shown being converted to a non child-resistant cap.

In FIG. 5 a utensile 20 is shown being used to pry levers and 15*a*, along with arc segments 11 and 11*a*, respectively, from cap 1, whereby the cap is converted into a nonchild-resistant cap by an adult consumer.

We claim:

1. A tamper-evident child-resistant cap and bottle comprising:

a bottle having a closed downward end and a generally cylindrical and upward-extending externally threaded neck;

a generally cylindrical closure cap having a downward-facing open end and an upward-facing closed end, and having internal threads in the open end threadedly engaged with the bottle neck;

a depending co-axial cylindrical skirt attached to the closed end of the closure cap;

at least one arc segment of the cylindrical skirt which is frangibly attached to the cylindrical skirt, and flexurally attached to the open end of the closure cap;

a plurality of upward-facing ratchet teeth integral with and radially disposed about the neck of the bottle;

a plurality of downward-facing ratchet dogs radially disposed within the each arc segment engaging the ratchet teeth at an angle permitting the dogs to override the teeth on the bottle neck during rotation onto the bottle and lock against the teeth to prevent removal of the cap; and a lever means integral with each arc segment and operable to break loose the frangible attachment of the arc segment to the remainder of the skirt and rotate the arc segment about its flexural attachment to the closure cap an amount sufficient to disengage the ratchet dogs of the arc segment from the ratchet teeth of the bottle neck, thereby permitting removal of the cap by unscrewing the cap from the bottle.

2. A tamper-evident child-resistant cap and bottle according to claim 1 in which ther are two arc segments spaced approximately 180 degrees apart.

3. A temper-evident child-resistant cap and bottle according to claims 1 or 2 in which the flexural attachment of the arc segment of the skirt to the closure cap provides a resilent bias urging the ratchet dogs into engagement with the ratchet teeth of the bottle neck.

4. A tamper-evident child-resistant cap and bottle according to claim 1, 2, or 3 in which the inward-facing ratchet dogs are elongated, cantelevered flexure beams which are canted from their respective points of engagement with the ratchet teeth towards the direction of installation rotation to their respective fixed attachment points on the inner surface of the arc segment.

5. A tamper-evident child-resistant cap and bottle according to claim 4 in which the ratchet dogs are canted at a sufficiently large angle with respect to an axial line to override the ratchet teeth in the direction of installation rotation with negligible friction, and to compressively engage the teeth of the ratchet in the direction of removal rotation, and thereby prevent rotation in the removal direction.

6. A tamper-evident child-resistant cap and bottle according to claims 2, 3 or 4 in which each arc segment portion of the depending skirt includes a rigid upstanding lever portion extending to the top plane of the closure end of the closure cap, whereby depressing the lever in an inward radial movement will rotate the arc segment outward on its flexure and disengage the ratchet dogs from the ratchet teeth of the bottle neck, permitting rotation of the cap in the removal direction.

7. A tamper-evident child-resistant cap and bottle according to claim 6 in which the flexural attachment of the arc segments may be torn loose by an adult consumer to convert the cap into a non-child resistant configuration.

8. A tamper-evident child-resistant cap and bottle according to claims 6 or 7 in which the flexural and frangible attachments of each arc segment and the attached lever may be torn loose by the application of a substantially higher force than is required to break the flangible attachments, thereby premitting the removal of the arc segments, the ratchet dogs and the levers to convert the cap to a non child-resistant configuration.

* * * * *